US010207166B2

(12) United States Patent
DeZordo et al.

(10) Patent No.: US 10,207,166 B2
(45) **Date of Patent: *Feb. 19, 2019**

(54) PROJECTILE LAUNCHING DEVICE

(71) Applicant: INPLAY PRODUCTS, INC, San Franicsco, CA (US)

(72) Inventors: Stephen Patrick DeZordo, Oakland, CA (US); Scott Shanks, San Francisco, CA (US)

( * ) Notice: Subject to any disclaimer, the term of this patent is extended or adjusted under 35 U.S.C. 154(b) by 235 days.

This patent is subject to a terminal disclaimer.

(21) Appl. No.: 14/278,302

(22) Filed: May 15, 2014

(65) Prior Publication Data

US 2017/0304700 A1 Oct. 26, 2017

Related U.S. Application Data

(63) Continuation-in-part of application No. 13/355,434, filed on Jan. 20, 2012, now Pat. No. 9,545,553.

(60) Provisional application No. 61/434,746, filed on Jan. 20, 2011.

(51) Int. Cl.

| | |
|---|---|
| ***A63B 67/06*** | (2006.01) |
| ***A63B 65/10*** | (2006.01) |
| ***A63B 63/00*** | (2006.01) |
| ***A63B 65/00*** | (2006.01) |
| ***A63B 59/30*** | (2015.01) |
| ***A63B 67/183*** | (2016.01) |
| *A63B 67/08* | (2006.01) |

(52) U.S. Cl.

CPC ..... *A63B 67/06* (2013.01); *A63B 59/30* (2015.10); *A63B 65/00* (2013.01); *A63B 67/183* (2016.01); *A63B 67/086* (2013.01); *A63B 2209/00* (2013.01); *A63B 2209/08* (2013.01); *A63B 2209/10* (2013.01); *A63B 2225/01* (2013.01)

(58) Field of Classification Search

CPC ... A63B 67/00; A63B 67/06; A63B 2067/063; A63B 71/02; A63B 2225/01; A63B 59/30; A63B 65/00; A63B 67/183; A63B 67/086; A63B 2209/00; A63B 2209/08; A63B 2209/10; F41B 15/00; F42B 6/00

See application file for complete search history.

(56) References Cited

U.S. PATENT DOCUMENTS

| | | | | |
|---|---|---|---|---|
| 429,531 | A * | 6/1890 | De Martino | A63B 65/08 124/5 |
| 2,050,914 | A * | 8/1936 | Anderson | A63F 9/02 273/317 |
| 2,080,489 | A * | 5/1937 | Knorpp | A63F 9/0208 273/336 |
| 2,371,567 | A * | 3/1945 | Wilson | A63B 65/125 473/514 |
| 2,634,982 | A * | 4/1953 | Gaede | A63B 67/06 473/588 |

(Continued)

*Primary Examiner* — Raleigh W Chiu

(57) ABSTRACT

A sports and games apparatus consisting of two rods and an aerodynamic projectile with an opening which receives the two rods. The projectile is launched by manipulating the rods in an opposing fashion. The opening of the projectile is of the appropriate size to allow for the rods to slide through, but not large enough that the projectile exhibits unwanted motions that inhibit accuracy during the launching motion. The rods are used to propel the projectile towards a variety of targets which interact with the projectile in various ways. The projectile may comprise a multitude of aerodynamic shapes and a multitude of methods for interacting with targets.

18 Claims, 7 Drawing Sheets

(56) References Cited

U.S. PATENT DOCUMENTS 2,679,711 A * 6/1954 Learnard ..... A42B 1/02 116/173
3,026,110 A * 3/1962 Hess ..... A63B 65/10 473/570
3,823,942 A * 7/1974 Duncan ..... A63B 65/12 273/338
3,895,801 A * 7/1975 Baird ..... A63B 63/00 273/350
3,976,297 A * 8/1976 Seymour ..... A63F 9/02 273/335
4,174,834 A * 11/1979 De Martino ..... A63B 67/086 446/48
4,204,682 A * 5/1980 Brown ..... A63B 65/10 273/401
4,209,936 A * 7/1980 Sklar ..... A63H 33/18 244/153 R
4,246,720 A * 1/1981 Stone ..... A63H 33/18 446/47
4,531,745 A * 7/1985 Leidy ..... A63B 67/06 273/336
5,362,067 A * 11/1994 Nelson ..... A63B 65/10 273/317
5,421,584 A * 6/1995 Planinc ..... A63B 65/125 273/338
5,438,972 A * 8/1995 Harbin ..... F41B 7/00 124/16
6,135,455 A * 10/2000 McNally ..... A63B 67/06 273/336
7,338,047 B2 * 3/2008 Kelley ..... A63B 67/066 273/118 R
9,545,553 B2 * 1/2017 de Zordo ..... A63B 67/06
2011/0074109 A1 * 3/2011 Werth ..... A63B 67/06 273/336
2012/0252611 A1 * 10/2012 Dezordo ..... A63B 67/06 473/589

* cited by examiner

Fig. 2
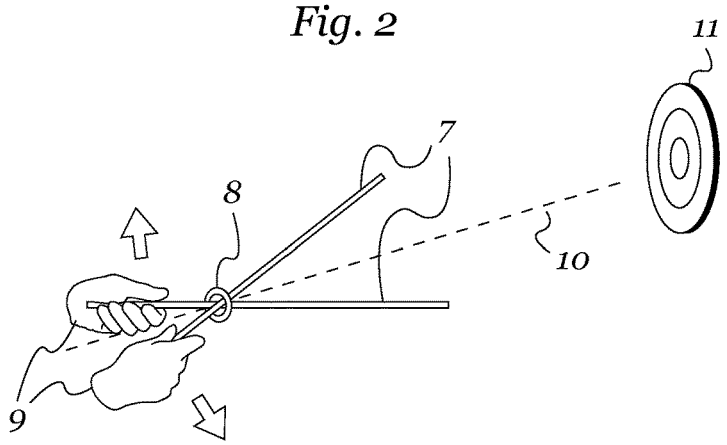
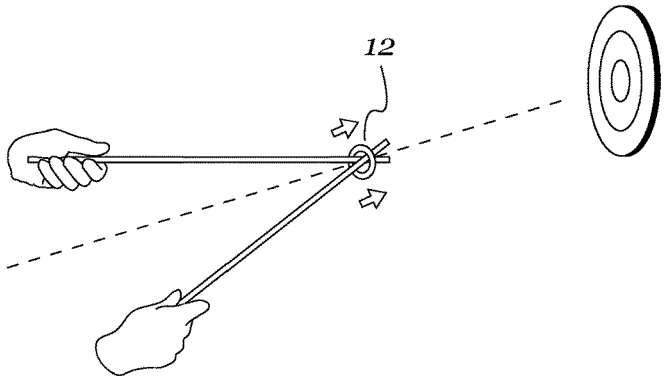
Fig. 2a
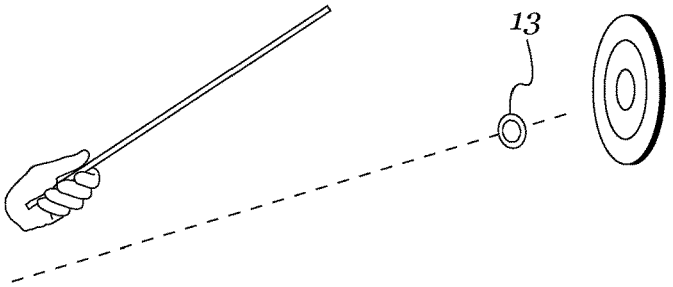
Fig. 2b
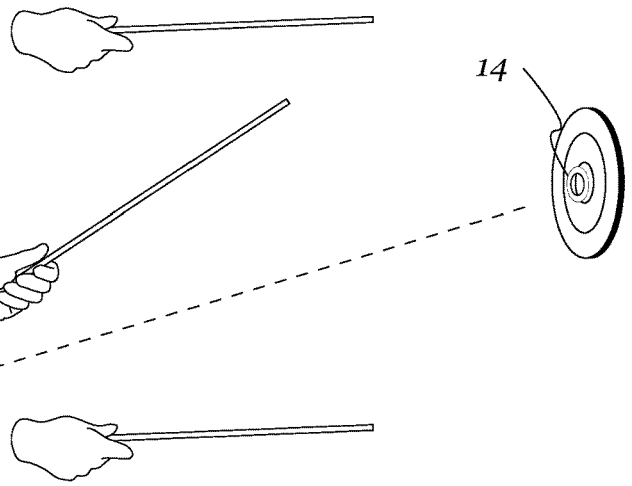
Fig. 2c

Fig. 3
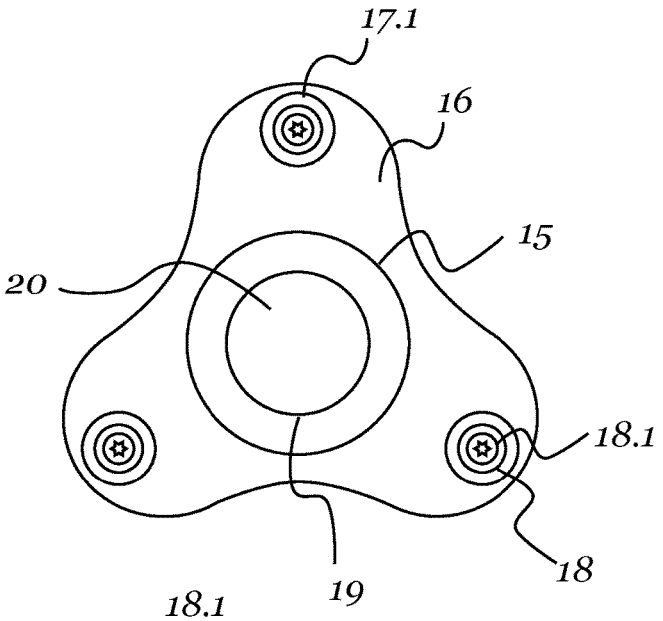
Fig. 3b
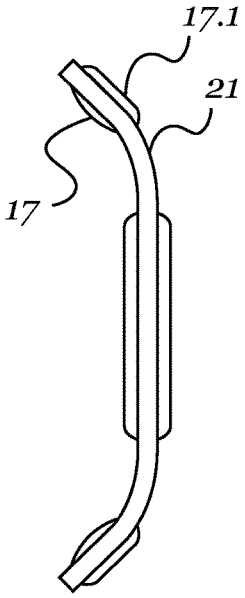
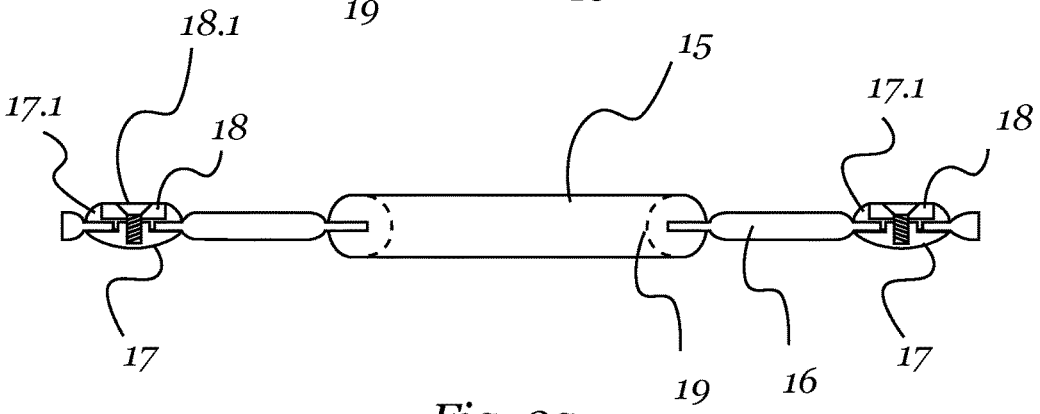
Fig. 3a

Fig. 7
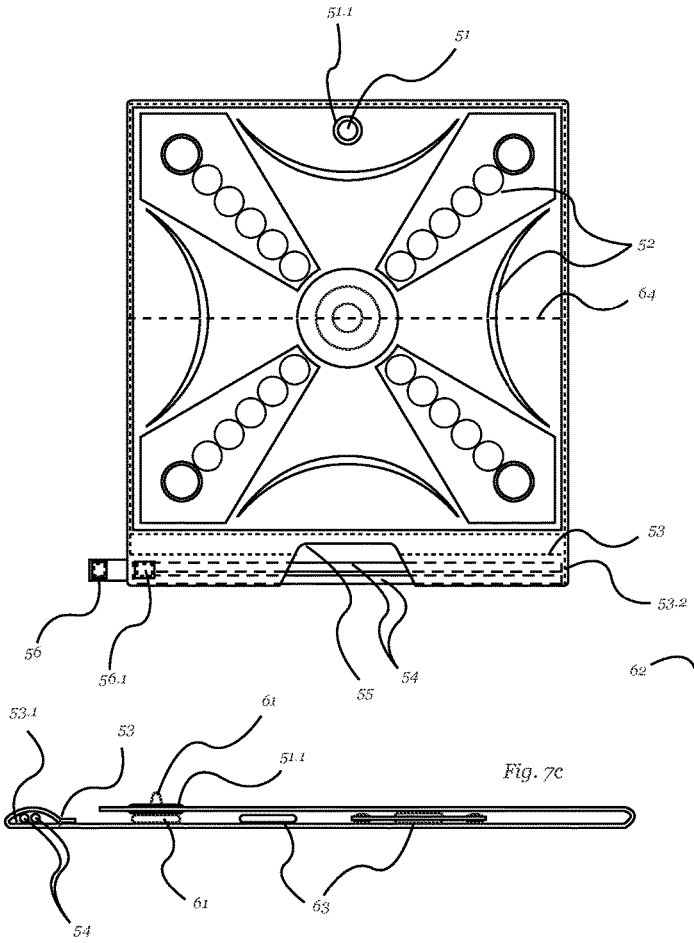
Fig. 7c
Fig. 7a
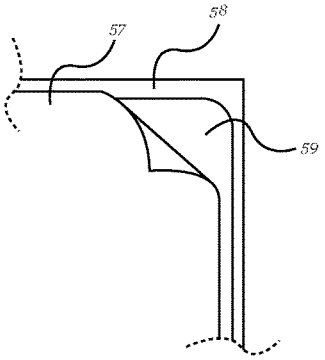
Fig. 7b
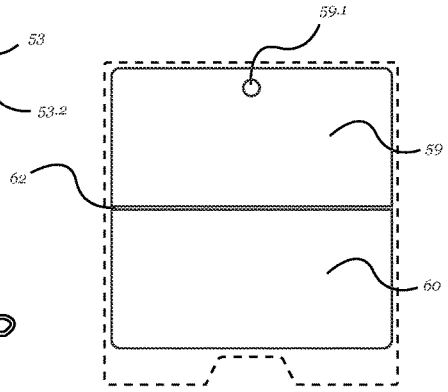

PROJECTILE LAUNCHING DEVICE

This application is a continuation-in-part application of U.S. Ser. No. 13/355,434, filed on Jan. 20, 2012, which claims benefit to U.S. provisional application Ser. No. 61/434,746 filed Jan. 20, 2011, the disclosures of which are incorporated in their entirety by reference herein.

FIELD OF INVENTION

Handheld launchers and projectiles for target games.

BACKGROUND OF INVENTION

The present invention generally relates to games where players manipulate two sticks or rods to propel a ring to another person who catches the ring with another stick or set of rods. An early American game "Game of Graces" exhibits the tossing of a ring with two sticks for the intent of catching the ring by another player with another set of sticks. Games using sticks to propel objects are known as disclosed in U.S. Pat. No. 4,174,834 and U.S. Pat. No. 429,531. While these inventions enable users to catch and release ring or disc shaped projectiles, their design and functionality are not suitable for the accuracy required of target based games due to the size of the opening required to achieve both catching and tossing with the same apparatus. The large opening allows for unwanted movement of the projectile during the launching method that inhibits accuracy and reduces the force and momentum imparted to the projectile by the rods, whereas a smaller opening that tightly constrains the opening of the projectile to the intersection of the sticks provides the accuracy necessary for target based games.

SUMMARY OF THE INVENTION

An object of the invention is to provide a manual apparatus utilizing a projectile comprised of resilient material with an opening for receiving two rods and a method of propelling the projectile by manipulating the rods in an opposing fashion while engaged within the opening of the projectile, thus propelling the projectile towards a target or game board with sufficient accuracy to hit desired sections of the board.

The primary innovation of the invention is the introduction of a smaller opening than used in similar games using two rods to propel an annular ring, such as the traditional colonial American game "Game of Graces" in which an annular ring is tossed and caught between two players using two rods to launch the ring and catch the ring by engaging one or both rods through the ring's opening while in flight. By introducing a smaller opening for the rods to engage, the opening of the projectile is tightly constrained to the intersection of the rods during the launching method, removing unwanted movement of the projectile away from the intended trajectory path. The tight constraint of the projectile to the intersection of the rods allows for the accuracy required for target based skill games. The optimal specification for the diameter of the opening of the projectile or annual ring is approximately 2.2 times the diameter of one of the rods. This ratio allows the ring to easily slide along the rods as the intersection of the rods as moves away from the shooter, yet prevents unwanted movement of the projectile away from the intended trajectory path. At approximately 10 times the diameter of one of the rods, the diameter of the opening of the projectile is rendered unsuitable for accurate targeting. A larger diameter also reduces the amount of directional force imparted to the projectile as the loose fit to the intersection of the rods can allow energy from the rods to be spent on motion by the projectile away from the intended trajectory.

Another object of the invention is that the projectile may be comprised of flight stabilizing aerodynamic appendages that orient the projectile in an optimal flight position or trajectory. The aerodynamic appendages may either stabilize the vertical flight position of the projectile as it leaves the rods during launch, or may reorient the projectile to a horizontal flight position during flight for longer distance. The aerodynamic elements can be used to enhance the flight characteristics for better targeting or for enjoyment and entertainment purposes. In its simplest form, an annular ring of the described specifications launched by a pair of rods has sufficient aerodynamic qualities to travel in the player's intended trajectory while also retaining its horizontal orientation throughout its flight, due in part to rotational momentum imparted by the rods upon the annular ring which acts as a stabilizing force on the ring. However, the ring and rods alone create significant speed and momentum that may create safety concerns for children and indoor play. The introduction of aerodynamic elements to the projectile can serve not only to stabilize the projectile in flight, but may also reduce the speed and momentum of the projectile to address safety concerns.

Another object of the invention is to provide the projectile with a method for interacting with a target so that the projectile's area of impact with the target is easily visible. The projectile can be propelled towards a target mounted vertically on a wall like traditional darts, or mounted horizontally on the ground, like lawn darts. The projectile can also be used to knock over or change the physical orientation of elements within a target, such as a set of lightweight bowling pins or a shooting gallery with targets that fall over when struck. The projectile can be adapted to best suit each of these game variations by modifying the aerodynamic properties of the projectile. Methods of temporarily attaching the projectile to a target upon impact can also be added to the projectile, such as but not limited to magnetic elements for ferrous targets or Velcro elements for fabric targets. The target may also have elements protruding from the target surface that engage the opening of the projectile.

The target may also have elements protruding from the target surface that engage the opening of the projectile so that the opening of the projectile encircles the protrusion upon impact.

Another object of the invention is to provide the projectile with a method for interacting with the target by defining areas on the target that the body of the projectile can overlap upon impact and remain in an overlapped position while temporarily attached to the target. The defined areas of the target are illustrated on the target with a graphic print. Overlapping the defined areas with the projectile can be used as a scoring mechanism in game play.

Another object of the invention is to provide game pieces that temporarily attach to a larger ferrous target with magnetic elements. The object of the game pieces is to provide a method for recording successful overlapping impacts by the projectiles upon graphically defined areas of the target. Another object of the game pieces is to provide an additional target which the projectiles can overlap upon impact. Overlapping and sustaining contact with a game piece can be used as a scoring mechanism in game play.

Another object of the invention is to provide a suitable playing surface that will prevent the magnetic game pieces from slipping on the target when it is impacted by the projectile. The playing surface is lightly textured to provide additional grip to the target beyond the magnetic force of the game pieces. The game pieces are also textured so that both the texture of the target and the texture of the game piece interact to counteract slipping downwards on the board due to gravitational attraction. The game pieces require this extra gripping feature because when the projectile impacts the target, vibrational forces can affect the magnetic bond of the game pieces to the target, resulting in a downward motion when the magnetic bond is weaker than the earths gravitational force upon the game piece.

Another object of the invention is to provide a suitable playing surface that will allow the magnetic game pieces to be repositioned on the target without having to remove them from the target. The game pieces, while having non-slip properties to counteract gravitational force, also have a weak enough attraction to the target surface that they may be slid across the target surface by manipulating them by hand Another object of the invention is the polarity of the magnetic elements used in the game pieces is aligned with the polarity of the magnetic elements used in the projectile. The game pieces are marked on one side to signify the magnetic polarity and thus which side should be placed against the target allowing for magnetic attraction to the magnetic elements contained in the projectile.

Another object of the invention is a magnetic game piece that has a protrusion that can interface with the opening of the projectile. The opening of the projectile may encircle the protrusion upon impact resulting in a scoring mechanism for game play. The game piece with the protrusion has magnetic elements with sufficient force to minimize movement on the board when impacted with the projectile. The game piece with protrusion has two magnetic elements, allowing it to be placed securely in the center of the target, bridging the gap between the ferrous elements of the target needed to create the folding hinge.

Another object of the invention is a projectile with appendages that allow for the overlapping of game pieces on the target surface while maintaining contact with target after impact. The appendages have magnetic elements that allow for the projectile to remain in contact with a ferrous target surface after impact. The magnetic elements are placed near the terminating end of the appendage to allow for the appendages to sufficiently overlap the magnetic game pieces and maintain magnetic adhesion to the target surface after impact. The projectile is best configured with three appendages. The use of three appendages has the advantage of providing a stable aerodynamic shape that will move through the air in a position parallel to the vertical surface of the target. With one appendage, the projectile's center of mass is out of balance and aerodynamic forces with cause the projectile to deviate from a straight path. With two appendages, the projectile may have stable pitch or yaw during flight, but not both, causing the projectile to flip or spin away from the desired parallel orientation, which prevents the magnetic elements from achieving sufficient contact with the ferrous target surface upon impact and falling off the target. Three appendages allows for pitch and yaw to be stabilized during flight, maintaining the desired orientation for impact on the target. More than three appendages create unwanted aerodynamic drag and incur unnecessary material expense. Three appendages are also best as it creates a tripod, which is the most stable formation for the adhesion of the projectile to the target surface with the minimum of material.

Another object of the appendages is to be flexible. The appendages are flexible so that they can bend around the the uneven surface created by the magnetic game pieces that are bonded to the target surface and still maintain magnetic adhesion to the target surface after impact. Flexibility of the appendages also increases the success of adhesion to the target surface as it dampens rebounding forces created by the projectile upon impact.

Another object of the appendages is to be rigid enough to dampen oscillating motion during flight. When the projectile is launched from the sticks, the weight of the magnets at the tips of the appendages causes the appendages to bend due to the inertial forces of the magnetic element being at rest, and the center projectile ring being in motion. When the magnetic elements gain momentum, they begin to oscillate, bending the appendage forward and backwards during flight. If the appendages do not have sufficient rigidity to dampen this oscillation, the magnetic elements will not be in proper position to make contact with the ferrous target upon impact. The heavier the magnetic elements, the more rigidity is required for the projectile to successfully orient and adhere to the target and/or overlap any game pieces. During launch and flight, the appendages should not bend at an angle of more than 45 degrees from the force of acceleration, nor should they continue to bend from the result of oscillation during flight after a distance of 2 meters at an angle of more than 20 degrees.

Another object of the appendages is for them to be short and rigid enough to prevent the magnetic elements attached to the ends of the appendages from bonding to each other. If the magnets attach during the launching process or during flight, the aerodynamic qualities of the appendages are compromised, as well as the projectile's ability to correctly orient itself for successful adherence to the ferrous target.

Another object of the appendages is for them to be of sufficient length to overlap game pieces upon impact with the ferrous target. The magnetic elements at the terminating end of the appendages should be of sufficient distance from the outside perimeter of the annular projectile to bridge the distance between the target surface and the projectile when the projectile is overlapping a game piece or another projectile bonded to the target surface. This distance is determined by the thickness of the game pieces being overlapped. When the projectile is overlapping a game piece, the appendage should not have to bend at an angle of more that 45 degrees for the magnetic elements at the tips of the appendages make full contact with the surface of the target. The best use is for the appendages to be of a length from the perimeter of the annular projectile of 25 to 50 mm. The distance from the outside perimeter of the annular projectile to the outside perimeter of the magnetic element assembly should be 10-25 mm. A longer length requires a thicker or more rigid appendage material to be used so that it conforms to the oscillation dampening requirements.

The material used for the appendage is a neoprene laminated with nylon fabric. The neoprene core is between 3-5 mm, and more preferably 4 mm in thickness. Neoprene has the best combination of flexibility and rigidity that gives the projectile stable flight and the ability to adhere to the ferrous target even when overlapping game pieces on the board. The elastic quality of neoprene also allows for the projectiles to be removed from the ferrous target repeatedly without damage or deformation despite the strong magnetic forces that bond it to the target. Neoprene appendages 4 mm in thickness is preferably over 3 or 5 mm. At 3 mm the appendages show more oscillation. The increase oscillation of the neoprene appendages prevents magnetic elements from making full contact with the surface target with enough consistency. If the projectile fails to make consistent or regular contact with the target surface, players lose interest. At 5 mm the neoprene appendages lack enough flexibility to bend around the uneven surfaces created by the magnetic game pieces that are bonded to the target surface and still maintain magnetic adhesion to the target surface after impact. Other materials of similar flexibility and durability may be used, such as but not limited to EVA foam, silicon rubber, natural leather, polymers, latex rubber, cloth, as well as laminates of these materials combined to achieve the desired properties.

Another object of the invention is a method for attaching magnetic elements to the projectile's appendages. Because of the repeated impact forces that the projectiles endure during game play, the magnets are attached to the neoprene appendages by means of a metal screw that passes through an opening in the center of the magnet. The magnet has a circular opening with a countersunk bevel to receive the screw and have a flush surface so the screw does not protrude from the surface of the magnet. The metal screw uses a star shaped hole for tightening that requires a special tool not commonly available, adding an extra element of safety to the design. A plastic socket with an opening to allow the screw to pass through and an opening the size of the magnet's diameter to receive the magnet comprise one side of the attachment method. A plastic cap on the opposite side of the neoprene that receives the screw comprises the other side of the attachment method. The screw is passed through an opening in the neoprene and then tightened into the receptacle of the plastic cap. The plastic cap and plastic socket also have elements that connect through the opening of the neoprene that allow for the cap and socket to be sonic welded. The opening in the socket has a depth equal to the thickness of the magnet so the magnet is flush with the outer surface of the socket. The socket has a rounded edge to minimize damage to objects or walls that may be struck accidentally during game play. The magnet, socket and screw have a flush outer surface when assembled to minimize damage to the target surface and any objects or wall that may be struck accidentally during game play.

Another object of the invention is propulsion sticks and projectiles of a certain weight that is optimum for the physical action of launching the projectile. A projectile that is too heavy requires extra effort on part of the persons launching the projectile, which can negatively affect targeting accuracy. A projectile that is too light easily succumbs to unwanted aerodynamic forces that create an erratic flight path. The weight of the sticks also affects the physical action of launching the projectile. The sticks should be between 5 and 10 grams, and the projectile is at an optimum weight between 1.5 and 3 grams. The sticks are comprised of solid pulltruded fiberglass, allowing for a thin diameter and high rigidity. Other materials may be used with similar density, texture and weight. For instance sticks made of fiberglass are too light and the physical feedback is not as enjoyable for players.

Another object of the invention is a ferrous target that provides a rigid surface for the projectiles to impact that is folded by means of a hinge on the horizontal centerline of the target. A rigid surface, as opposed to flexible magnetically receptive surfaces used in other magnetic dart games, has the benefits of minimizing vibration from impact by the projectile, which can dislodge magnetic game pieces bonded to the board. Another object of the rigid and foldable target is that it can be leaned against another object and still maintain it's shape when the target is turned 90 degrees so that the hinge is oriented in a vertical direction. This allows the target to be used in locations where a hanging mechanism is not available. The radial symmetry of the graphic on the target allows for the game to be played in either an upright or sideways orientation. Another object of having a rigid folding target is that the magnetic game pieces can be left on the surface of the target when it is folded, allowing for game players to leave their pieces in place, thus saving the scoring for the game when the target is being transported in the folded position, and eliminating the need for a separate carrying mechanism for the game pieces.

Another object of the inventions is to use the sticks used for propelling the projectile as a handle integrated into the target for portability. When hanging, the sticks can be stored in a sleeve sewn at the bottom edge of the target. When folded, an opening in the sleeve allows for the sticks to serve as a handle mechanism.

Another object of the invention is to have a mechanism for hanging the target that also serves as a receptacle for storing a game piece that has a protrusion, allowing for all the game pieces to be stored on the board without needing an extra pocket or receptacle. The game piece with the spike shaped protrusion is used as a scoring mechanism. If the opening of the projectile encircles the protrusion of the game piece, a scoring event happens. The game piece with protrusion has two magnetic elements, allowing it to be placed securely in the center of the target, bridging the gap between the ferrous elements of the target needed to create the folding hinge.

BRIEF DESCRIPTION OF THE DRAWINGS

FIG. 1 shows a side view of the projectile in its simplest configuration.

FIGS. 2-2*c* show the projectile and the rods and demonstrates the method for launching the projectile.

FIG. 2 shows a method for launching the projectile at the beginning of a launch.

FIG. 2*a* shows a method for launching the as the projectile is propelled forward to the tip of the rods.

FIG. 2*b* shows the projectile travelling through the air in a vertical position.

FIG. 2*c* shows the projectile travelling closer to a vertical target in a vertical position.

FIG. 3 shows a front view of the projectile with aerodynamic elements for a vertical flight position.

FIG. 3*b* shows a side view of the projectile with aerodynamic elements for a vertical flight position.

FIG. 5*a* shows the method for launching the projectile as the projectile is propelled forward to the tip of the rods.

FIG. 5*b* shows the projectile changing position to horizontal during flight.

FIG. 6 shows the projectile interacting with a flat surface target mounted vertically.

FIG. 6*d* shows the projectile altering the physical orientation of objects.

FIG. 7 shows a rigid ferrous target with folding hinge.

FIG. 7*a* shows layers of the rigid ferrous target.

FIG. 7*b* shows a side view of the rigid ferrous target and a sleeve which houses the rods.

FIG. 7*c* shows another view of the rigid ferrous target with the folding hinge.

DETAILED DESCRIPTION OF THE DRAWINGS

Figure 1:
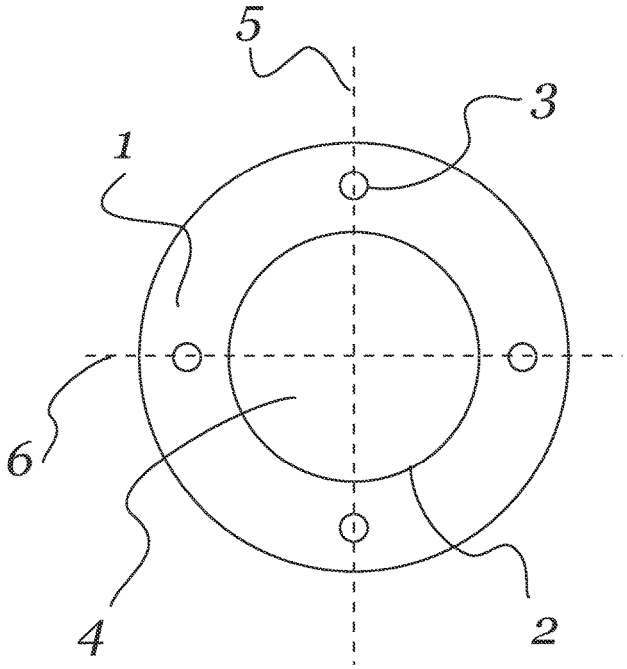
FIG. 1 shows a front view of the projectile in its simplest configuration.
Figure 1A:
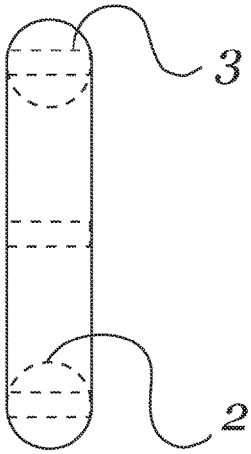

The projectile as shown in FIG. 1 and FIG. 1*a* comprises an annular ring 1 with magnets 3 embedded in the body of the ring. The ring has a smooth circumferential edge 2 around the opening 4, allowing the ring to slide easily along the rods 7 as shown in FIG. 2. This configuration is for propelling the ring in a vertical position where the both the vertical 5 and horizontal 6 axis of the ring is perpendicular to the flight trajectory 10 throughout the flight 13. Both axes are parallel with the surface of the target upon impact. The embedded magnets would then fix the ring on to a magnetically receptive target at the area of impact 14.

FIG. 2-FIG. 2*c* shows the method for propelling the projectile 8 with the rods 7. The motion begins by inserting the rods 7 through the opening of the projectile 4. Then, while holding one rod in each hand 9, rods are crossed at an angle of approximately 90-45 degrees with one stick on top of the other so that the intersection of the sticks is located inside the opening of the projectile 8. The hands are then moved apart in opposite directions. The intersection of the sticks at the beginning of the motion 8 is closer to where the hands are holding the rods. As the hands are moved apart, the intersection of the sticks moves away from the hands and the projectile, being constrained to the intersection of the sticks, is propelled forward until the sticks no longer intersect at which point the projectile is released in flight 13. Optimum accuracy is obtained by the bilaterally symmetrical opposing outward motion of both hands holding the rods so that the location of the intersection of the rods at the beginning of the motion 8 and the location at which the rods separate 12 are located on a line in space that intersects with the intended target area 14. The projectile remains removably attached to the target at the area of impact by a method such as, but not limited to, magnetic attraction.

The projectile as shown in FIG. 3-FIG. 3*b* is an example of a projectile with aerodynamic elements that reduce the speed of the projectile and stabilize the projectile in a vertical flight position. The projectile comprises an annular ring 15 with an opening 20 having circumferential edges 19 with aerodynamic appendages 16 projecting radially from the outer edge of the ring. Each appendage is radially symmetrical and is comprised of a semi-rigid material that allows for bending 21 with air flow during flight. Each appendage has a resilient housing 17.1 for a toroidal magnet 18 which attaches to the semi-rigid material 16 with a metal screw 18.1 and resilient cap 17 assembly. Additional bonding occurs between the magnet housing and cap with glue or sonic welding. During flight, the appendages may bend and oscillate 21 no more than 45 degrees. The appendages slow the projectile to safer speeds and stabilize the projectile's flight position by imparting equal aerodynamic drag forces around the radius of the ring.

Figure 4:
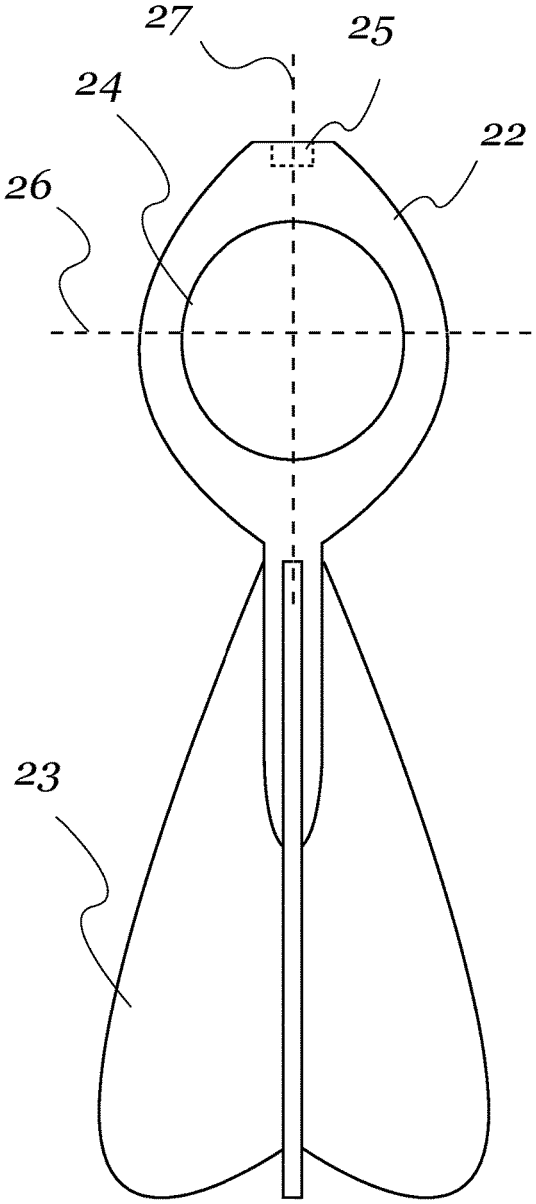
FIG. 4 shows a side view of the projectile with aerodynamic elements for a horizontal flight position.
Figure 4A:
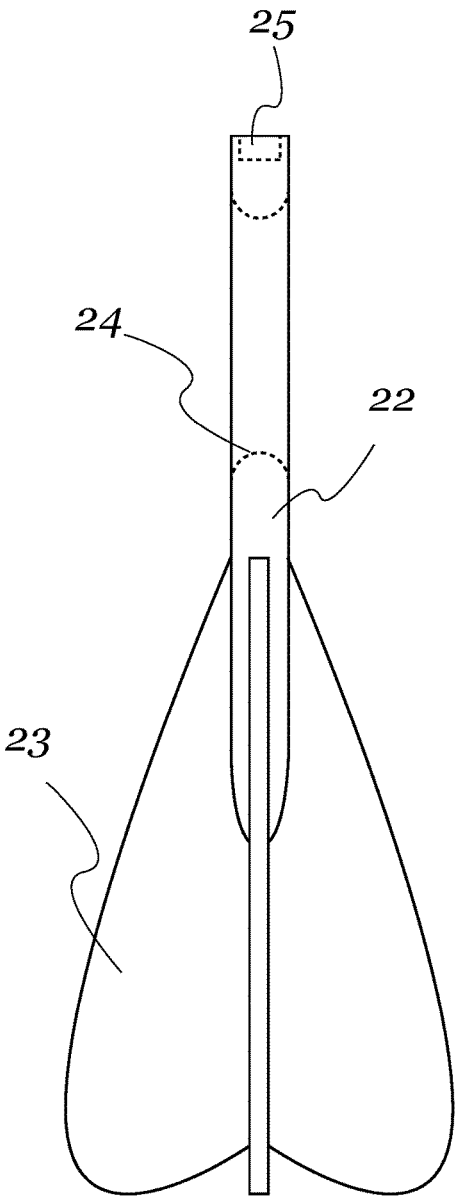
Figure 5:
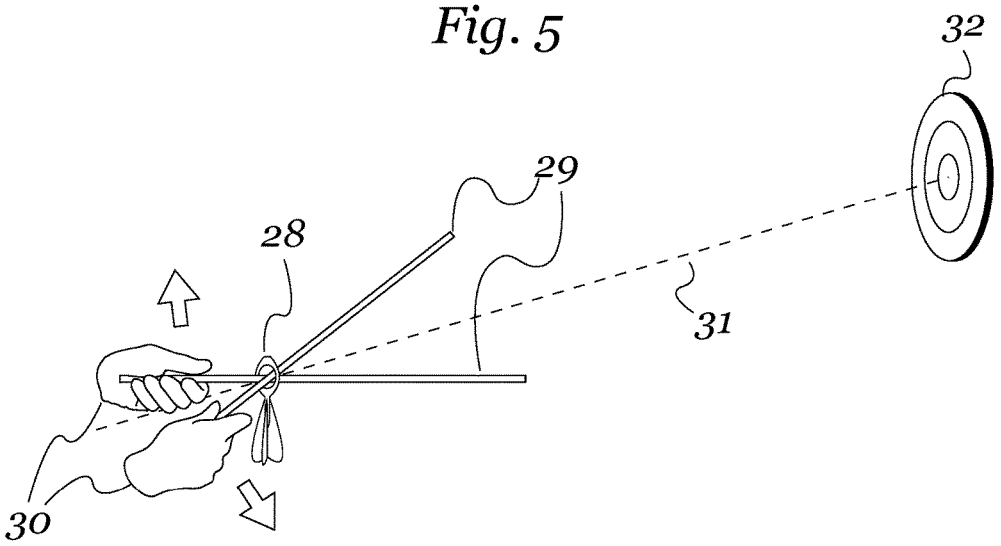
FIG. 5 shows the method for launching the projectile at the beginning of a launch.
Figure 5A:
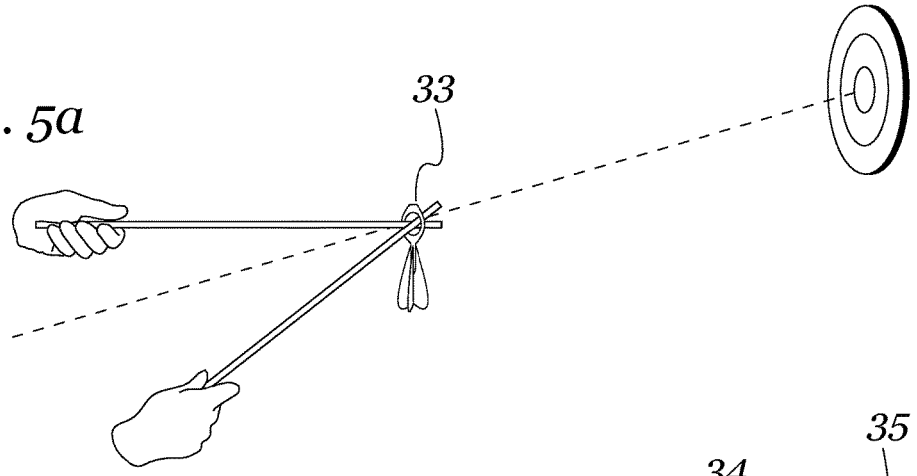
FIGS. 5*a*-5*b* show the projectile and the rods and the method for the launching the projectile with aerodynamic elements for a horizontal flight position.
Figure 5B:
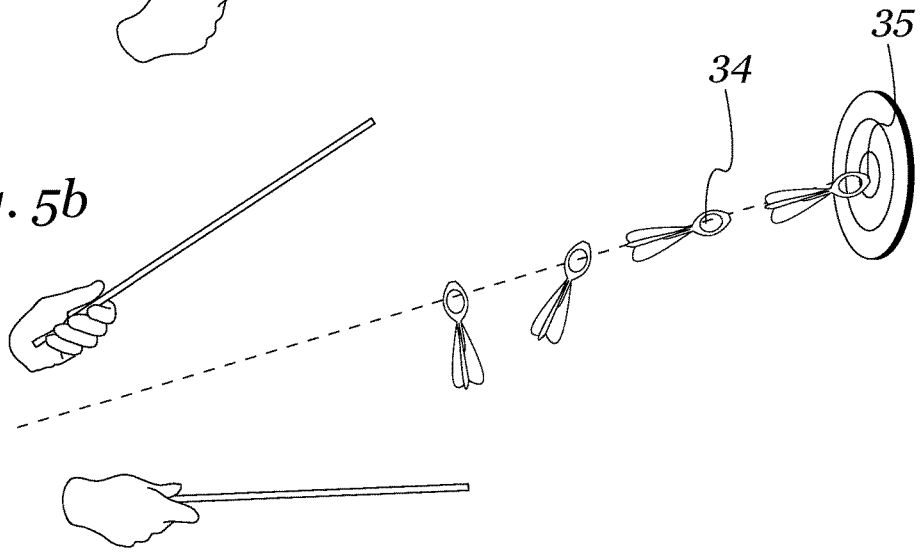

The projectile as shown in FIG. 4 and FIG. 4*a* is an example of a projectile with aerodynamic elements that change the flight position from vertical to horizontal after being released from the rods as shown in FIG. 5. The projectile is comprised of a resilient body 22 with an opening with smooth circumferential edges 24, an aerodynamic element, similar to the flights of a traditional dart 23, attached to the outer edge of the projectile, and a magnet 25 embedded on the outer edge of the ring opposite the aerodynamic element 23. At the beginning of the motion to propel the projectile with the rods 28, the projectile is in a vertical position, with its vertical axis 27 perpendicular to the intended flight trajectory 31. As the hands 30 holding the rods 29 are moved in opposite directions and the projectile slides away from the hands, the projectile remains approximately in a vertical position 33. After being released from the rods, the aerodynamic element creates drag which rotates the projectile on its horizontal axis 26 until the vertical axis is parallel with the flight trajectory 34. This creates a slimmer aerodynamic profile as it travels in flight, allowing for greater distances than the projectile in FIG. 3. This also aligns the magnet 25 (or other method of attaching to the target) at the leading edge of the projectile to impact the target in the correct position 35.

Figure 6:
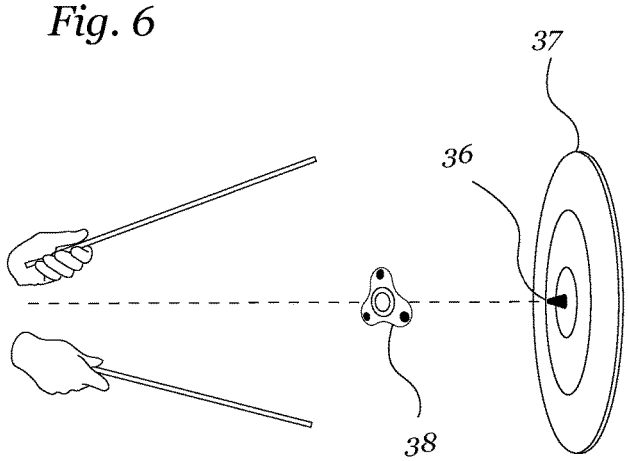
FIG. 6-6*d* show various targets that can be used to judge the accuracy of the projectile's trajectory.
Figure 6A:
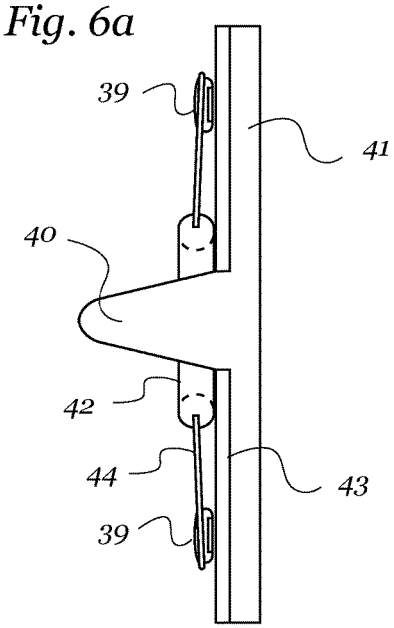
FIG. 6*a* shows the projectile interacting with a target comprising a protruding element.
Figure 6B:
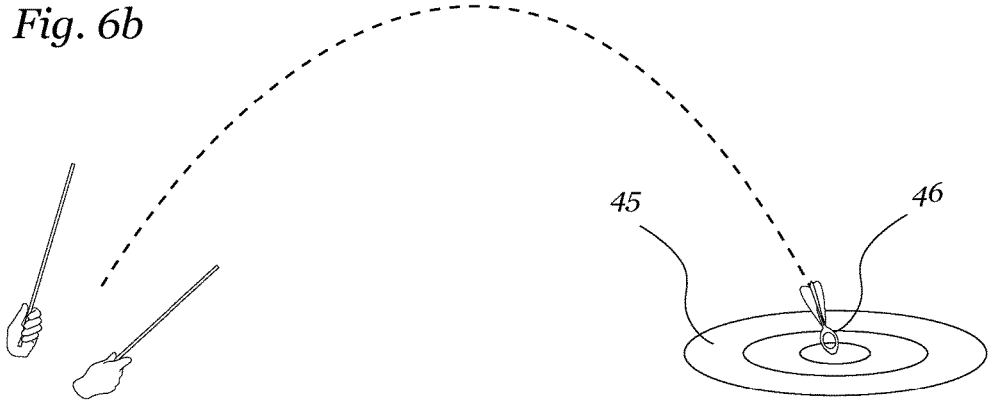
FIG. 6*b* shows the projectile interacting with a target in a horizontal position.
Figure 6C:
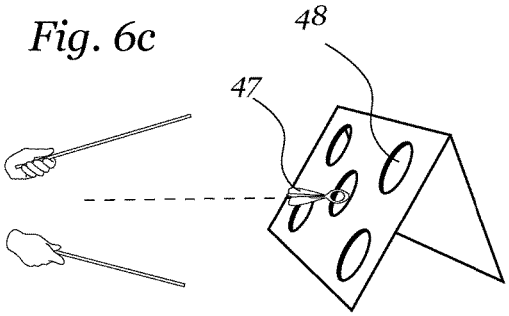
FIG. 6*c* shows the projectile interacting with a target with openings.
Figure 6D:
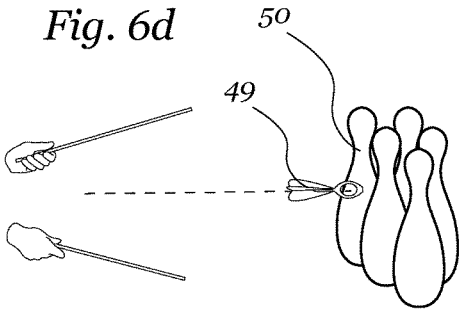

FIGS. 6-6*d* demonstrate various methods the projectile can interact with targets. FIG. 6 demonstrates a flat surface target 37 mounted vertically like a traditional dartboard. The projectile as described in FIG. 3 is propelled towards the target in a vertical flight position 38. Upon impact with the target FIG. 6*a*, the aerodynamic appendages 44 with attached magnets 39 attract to a ferrous layer 43 which is bonded with the target substrate 41. The described target is also comprised of a protruding element 40 that can engage with the opening of the projectile 42. The player's accuracy can be determined by the different areas drawn on the surface of the target 37, or by engaging the projectile's opening 42 with the target's protrusion 40. FIG. 6*b* demonstrates a target laid in a horizontal position 45, where the player must follow an arcing trajectory with the projectile 46 to engage the target. FIG. 6*c* demonstrates a target with openings 48 that the projectile 47 can enter or pass through. FIG. 6*d* demonstrates a target 50 where the projectile 49 alters the physical orientation of objects, in this case a set of lightweight pins that are knocked over upon impact.

FIGS. 7-7*c* demonstrate a rigid ferrous target with folding hinge. The target is comprised of an inner ferrous layer 59, a target surface layer 57, and an outer covering layer 58. The target surface layer 57 is comprised of a flexible, water resistant film such as, but not limited to, vinyl or PVC vinyl, which is lightly textured to improve the bonding of the magnetic game pieces 63. The target surface has a graphic 52 printed on the surface to denote scoring mechanisms for game play. The outer covering 58 is comprised of a flexible water resistant film such as but not limited to vinyl or PVC vinyl. The outer, inner, and target surface layers are laminated together. The inner ferrous layer is comprised of two elements 59-60, arranged with a gap 62 between the two elements horizontally aligned on the center of the target. The outer layers are bonded along the space in this gap 62 to create a hinge 64. The outer layers extend beyond the inner ferrous layer on the bottom side and are folded and bonded horizontally with a seam 53 to create a sleeve 53.1 that houses the sticks. One side of the sleeve opening is bonded with a seam to create at terminus of the sleeve opening 53.2. A tab of flexible material 56 is folded over the opposite opening of the sleeve to secure the sticks 54 once they are positioned inside the sleeve. The tab is secured with a temporary bonding mechanism 56.1 such as Velcro or a snap. An opening cut into the sleeve 55 exposes the sticks and creates a space for manually gripping the sticks that is used as a handle for transporting the target. When folded, the target has an opening 51 to allow a game piece with a protrusion 61 to be contained within the target while bonded to the playing surface. An opening in the inner ferrous layer and both outer layers receive a grommet 51.1 that the protrusion of the game piece passes through. Other game pieces 63 may also be stored on the playing surface while folded.

What is claimed is:

1. A sports and games apparatus comprising:

a. a plurality of rods having a first end and second end, and said rods having equal diameter at the first end and having a diameter suitable for grasping with one hand at the second end, b. a projectile having an opening wherein the diameter of said opening is sufficient to allow for the first ends of said rods to pass through said opening simultaneously, and said opening allows for said rods to slidably travel through said opening, and the diameter of said opening is smaller than five times the diameter of the first end of one of said rods, and said opening having a circumferential edge, and said projectile having an aerodynamic body, and c. a target comprising a surface which can be folded and said target having a method of containing said rods by means of an enclosure which contains an opening of sufficient size to allow manually grasping said rods as a handle.

2. The apparatus of claim 1, wherein said aerodynamic body further comprises aerodynamic elements wherein said aerodynamic elements stabilize said ring during flight, such that said ring retains a substantially stable position during the flight path, and wherein said position is substantially planar to a target such that said ring is in position to affix to said target.

3. The apparatus of claim 1, wherein said aerodynamic body further comprises aerodynamic elements wherein said aerodynamic elements stabilize said ring during flight, such that the position of said ring is aerodynamically altered during the flight path, and wherein said position is substantially perpendicular to a target during flight, such that the outside edge of said ring is in position to interface with said target.

4. The apparatus of claim 1, wherein said target comprises a means for said projectile to remain attached to said target at the area of impact of said projectile to said target with three points of attachment.

5. The apparatus of claim 1, wherein the aerodynamic body further comprises aerodynamic appendages having a plurality of three, and said aerodynamic appendages contain a means of attachment and said aerodynamic appendages have a flexible property.

6. The apparatus of claim 5, wherein said aerodynamic body and said aerodynamic appendages are comprised of a neoprene core laminated with nylon fabric.

7. The apparatus of claim 6, wherein said neoprene core is between 3-5 mm thick.

8. The apparatus of claim 5, wherein said projectile is between 1.5 and 3 grams.

9. The apparatus of claim 5, wherein said means of attachment is a magnet, and wherein said magnet has a first side and a second side, and wherein the first side is securely attached to said aerodynamic appendages and the second side contacts the target, and such that the second side has a flush surface.

10. The apparatus of claim 1, wherein said target comprises a surface and a surface element protruding from said surface, and the projectile has a means of attachment to said target independent of said element protruding from said surface.

11. The apparatus of claim 10, wherein the diameter of said surface element is smaller than opening of said projectile, and wherein the length of said surface element is greater than the thickness of the projectile.

12. A sports and games apparatus comprising:

a. a plurality of rods having a first end and second end, and said rods having equal diameter at the first end and having a diameter suitable for grasping with one hand at the second end, b. a projectile comprising an annular ring wherein the diameter of said ring is sufficient to allow for the first ends of said rods to pass through said opening simultaneously, and said opening allows for said rods to slidably travel through said opening, and the diameter of said opening is smaller than five times the diameter of the first end of one of said rods, and c. aerodynamic elements attached to said ring, wherein said aerodynamic elements stabilize said ring during flight, such that the position of said ring is aerodynamically altered during the flight path, and wherein said position is substantially perpendicular to a target during flight, such that the outside edge of said ring is in position to interface with said target.

13. The apparatus of claim 12, wherein said target comprises an opening or plurality of openings wherein said openings allow any element or the entire body of the projectile in claim 12 to enter said openings.

14. A sports and games apparatus comprising:

a. a plurality of rods having a first end and second end, and said rods having equal diameter at the first end and having a diameter suitable for grasping with one hand at the second end, b. a projectile comprising an annular ring wherein the diameter of said ring is sufficient to allow for the first ends of said rods to pass through said opening simultaneously, and said opening allows for said rods to slidably travel through said opening, and the diameter of said opening is smaller than five times the diameter of the first end of one of said rods, and c. aerodynamic elements attached to said ring, wherein said aerodynamic elements stabilize said ring during flight, such that said ring retains a substantially stable position during the flight path, and wherein said position is substantially planar to a target such that said ring is in position to affix to said target.

15. The apparatus of claim 14, wherein the aerodynamic elements further comprise aerodynamic appendages having a plurality of three, and said aerodynamic appendages contain a means of attachment and said aerodynamic appendages have a flexible property.

16. The apparatus of claim 15, wherein said aerodynamic body and said aerodynamic appendages are comprised of a neoprene core laminated with nylon fabric, and wherein said neoprene core is between 3-5 mm thick.

17. The apparatus of claim 14, wherein said projectile is between 1.5 and 3 grams.

18. The apparatus of claim 15, wherein said means of attachment is a magnet, and wherein said magnet has a first side and a second side, wherein the first side is securely attached to said aerodynamic appendages and the second side contacts the target, and such that the second side has a flush surface.

* * * * *